US009347219B2

(12) United States Patent
Rasch et al.

(10) Patent No.: US 9,347,219 B2
(45) Date of Patent: May 24, 2016

(54) CONVERTIBLE ROOF ELEMENT AND STRUCTURE WITH METHOD OF OPERATION

(71) Applicant: SL Rasch GmbH Special & Lightweight Structures, Leinfelden-Echterdingen (DE)

(72) Inventors: Bodo Rasch, Leinfelden-Echterdingen (DE); Juergen Bradatsch, Leinfelden-Echterdingen (DE); Frei Otto, Leonberg (DE); Martin Leitner, Sterzing (IT)

(73) Assignee: SL Rasch GmbH Special & Lightweight Structures, Leinfelden-Echterdingen (DE)

( * ) Notice: Subject to any disclaimer, the term of this patent is extended or adjusted under 35 U.S.C. 154(b) by 0 days.

(21) Appl. No.: 14/574,087

(22) Filed: Dec. 17, 2014

(65) Prior Publication Data

US 2015/0101259 A1 Apr. 16, 2015

Related U.S. Application Data

(63) Continuation of application No. PCT/EP2013/061580, filed on Jun. 5, 2013.

(30) Foreign Application Priority Data

Jun. 26, 2012 (DE) ..... 10 2012 210 824

(51) Int. Cl.
*E04B 7/08* (2006.01)
*E04B 7/10* (2006.01)
(Continued)

(52) U.S. Cl.
CPC ..... *E04B 7/166* (2013.01); *E04B 1/342* (2013.01); *E04B 1/3431* (2013.01);*E04B 1/34357* (2013.01); *E04B 7/14* (2013.01); *E04D 5/00* (2013.01); *E04H 4/086* (2013.01); *E04H 4/10* (2013.01)

(58) Field of Classification Search
CPC ..... E04B 2001/1996; E04B 1/34384; E04B 7/08; E04B 7/10; E04B 7/107; E04B 7/14; E04B 9/18; E04B 7/166; E04B 1/342; E04B 1/3431; E04B 1/34357; E04H 4/086; E04H 4/088; E04H 4/10; E04H 4/101; E04H 6/32; E04H 15/00; E04H 15/02; E04H 15/32; E04H 15/42; E04H 15/425; E04H 15/54
USPC ..... 52/66, 222, 3, 83; 135/90, 94, 125, 908, 135/129, 123; 242/364, 364.9, 362, 362.1
See application file for complete search history.

(56) References Cited

U.S. PATENT DOCUMENTS 2,415,202 A 2/1947 Ferguson
3,288,158 A 11/1966 Gugliotta
(Continued)

FOREIGN PATENT DOCUMENTS

CA 2720796 A1 5/2012
CH 395509 12/1965
(Continued)

*Primary Examiner* — Phi A
(74) *Attorney, Agent, or Firm* — Hackler Daghighian & Martino

(57) ABSTRACT

A convertible roof element includes a peripheral structure with an opening to be at least partially closed by a membrane, an edge rope and at least one guide rope forming a rope band tensioned against each other. The convertible roof element has a parking position and at least one shading position, the parking position running along the peripheral structure and the at least one shading position running across the opening of the peripheral structure. The edge rope is fixed at its ends via a first tensioning device to the peripheral structure. The at least one guide rope is secured to the edge rope at one end and at the other end to the peripheral structure by means of a further tensioning device. The tensile force of the further tensioning device is variable so that the edge rope is moveable from the parking position into the at least one shading position.

29 Claims, 9 Drawing Sheets

(51) Int. Cl.

| | |
|---|---|
| ***E04B 7/16*** | (2006.01) |
| ***E04B 1/342*** | (2006.01) |
| ***E04B 1/343*** | (2006.01) |
| ***E04B 7/14*** | (2006.01) |
| ***E04D 5/00*** | (2006.01) |
| *E04H 4/10* | (2006.01) |
| *E04H 4/08* | (2006.01) |

(56) References Cited

U.S. PATENT DOCUMENTS

| | | | | | |
|---|---|---|---|---|---|
| 3,510,996 | A | | 5/1970 | Popil | |
| 3,777,425 | A | * | 12/1973 | Le Bourgeois | 52/2.23 |
| 4,494,707 | A | * | 1/1985 | Niibori et al. | 242/390.2 |
| 4,683,933 | A | * | 8/1987 | Dunbar | 160/273.1 |
| 6,003,269 | A | * | 12/1999 | McRee | 52/6 |
| 6,012,505 | A | * | 1/2000 | Wurz et al. | 160/66 |
| 8,800,214 | B2 | * | 8/2014 | Silberman et al. | 52/64 |

FOREIGN PATENT DOCUMENTS

| | | | |
|---|---|---|---|
| DE | 1684636 | B | 5/1971 |
| EP | 1387025 | A1 | 2/2004 |
| FR | 796740 | | 4/1936 |
| FR | 1464097 | A | 7/1966 |
| FR | 1577089 | A | 8/1969 |
| FR | 2 041 923 | A5 | 2/1971 |

* cited by examiner

CONVERTIBLE ROOF ELEMENT AND STRUCTURE WITH METHOD OF OPERATION

CROSS-REFERENCE TO RELATED APPLICATIONS

This continuation application claims priority to PCT/EP2013/061580 filed on Jun. 5, 2013 which has published as WO 2014/001045 A1 and also the German application number 10 2012 210 824.6.4 filed on Jun. 26, 2012, the contents of which are fully incorporated herein with these references.

FIELD OF THE INVENTION

The invention relates to a convertible roof element comprising a peripheral structure with an opening to be closed, by a membrane and at least one guide rope forming a rope band, wherein the roof element has a parking position and at least one shading position and wherein the parking position runs along the peripheral structure and the shading position runs through the opening of the peripheral structure.

BACKGROUND OF THE INVENTION

Convertible roof elements for shading squares and inner courtyards have the advantage over static structures that when shading is no longer required, e.g. during the evening hours, the element providing the shade can be moved and the warm air underneath it can escape upwards. Furthermore, all the areas no longer covered with a roof are able to radiate energy into the cold night sky. This enables the square shaded during the day to cool down over night.

In case of the roof structure known from http://www.sl-rasch.de/ ("Convertible Roof for the Quba Mosque, Medina, Kingdom of Saudi Arabia"), parallel running guide ropes are stretched over the inner courtyard of a building and are braced on opposing sides of the building surrounding the inner courtyard. Along the guide ropes are displaceably arranged two membranes, which can be slid into a parking position on either building wall, where they are stored in a collapsed condition.

The disadvantage of this roof structure is that the guide ropes may impair the aesthetic impression of the building when the roof is open (membrane in parking position). Moreover, there is a risk that the square underneath it may be soiled by bird droppings.

The object of the invention is therefore to propose a convertible roof element and a roof structure that enable flexible shading of the inner courtyard and avoiding the disadvantages mentioned above.

SUMMARY OF THE INVENTION

The roof element according to the invention has an edge rope which is braced against the rope band both in the parking position and in the shading position, and also when the peripheral rope is transferred to one of the two positions.

The edge rope is fixed at its ends by a first tensioning device to two fixing regions of the peripheral structure spaced a certain distance apart. The rope band comprising the at least one guide rope is secured between the two fixing regions to the edge rope and by means of a further tensioning device to the peripheral structure.

According to the invention the tensile force of the first tensioning device and/or of the further tensioning device is variable, thus enabling the edge rope to be moved from the parking position into the shading position. When the roof element according to the invention is transferred to the parking position the tensile forces exerted by the first and further tensioning devices onto the edge rope are regulated so that the tensile force exerted by the further tensioning device through the guide ropes onto the edge rope is stronger than the tensile force which is exerted by the first tensioning device directly onto the edge rope. The edge rope is therefore pulled by the guide rope in the direction of the peripheral structure until the edge rope runs along the peripheral structure (parking position). The tensile forces exerted by the first and further tensioning devices onto the edge rope therefore determine the position, direction of movement and the shape of the edge rope. The points (connection points) at which the rope band is secured to the edge rope also determine the shape of the edge rope. The connection points are chosen so that the edge rope, in the parking position, runs along the peripheral structure and so that in the shading position at least a portion of the edge rope runs through the opening of the peripheral structure and preferably forms an arc above the opening of the peripheral structure.

In the case of the roof element according to the invention the membrane is at least partially folded up in the shading position, is fixed to at least one connection point of the edge rope and coves part of the opening of the peripheral structure. The membrane can be fixed to the edge rope directly or via a suspension device which is moved as far as the edge rope to span the membrane. In order to span the membrane above the opening of the peripheral structure, the membrane is not only fixed to the edge rope at at least two further points, but it is also fixed to the peripheral structure and/or to the guide ropes. The fixing of the membrane to the edge rope can in this case be detachable (e.g. via a displaceable suspension device (see below)) or permanent.

The rope band preferably comprises several guide ropes whose one end is secured to a connection point of the edge rope and whose other end is secured to a peripheral point of the peripheral structure, the connection points being arranged between the fixing regions of the edge rope.

However, it is also conceivable for a rope band to be formed by spanning a single guide rope several times to and fro between the rope band and peripheral structure. The guide rope is then deflected to the peripheral structure via deflector rolls fitted on the edge rope. In this case both ends of the guide rope are preferably secured by means of the further tensioning device to the peripheral structure. By increasing the tensile force of the further tensioning device (and/or reducing the tensile force of the first tensioning device) part of the guide rope forming the rope band is shortened and the edge rope is pulled in the direction of the peripheral structure.

The tensile forces generated by the bracing of the edge rope and the guide ropes, as well as by wind, are absorbed by the peripheral structure. The design of the peripheral structure therefore depends on the size/weight of the membrane to be spanned and the wind conditions to be expected.

The membrane is preferably produced from a weatherproof material with a high tensile loading capacity, e.g. teflon or a material with similar properties regarding tensile load and weather resistance.

The roof element according to the invention serves to shade a square arranged inside the peripheral structure. In the design according to the invention the displaceable elements of the roof element (guide rope, edge rope, and membrane)—if no shading is required—can be moved into a parking position in which no disturbing elements of the roof element are visible.

Embodiments of the invention are set forth herein. Rope winches, onto which the guide rope is rolled in the parking position, are preferably used as a further tensioning device. In this manner the guide ropes can be stored in the parking position in a space saving manner. Preferably a separate rope winch is provided for each guide rope. This is particularly advantageous when the peripheral structure has a shape different from that of the edge rope spanned in the shading position. In order to transfer the edge rope to the parking position the guide ropes can therefore be rolled on at different speeds (different number of revolutions and/or different rope winch diameter) in order to adapt the shape of the edge rope to the peripheral structure. As an alternative to this slides moveable on rails may be used as further tensioning devices. This possibility is of interest, for example, for an embodiment in which the rope band is formed by a single guide rope.

In a particularly preferred embodiment the rope winches are synchronized to allow uniform transfer of the edge rope and membrane to the different positions. The synchronization takes place by means of a control device.

The membrane is preferably secured to suspension devices which are movable along the guide rope and can be fixed to suspension devices along the guide rope. Several suspension devices are preferably provided for each guide rope. The suspension devices can be fixed to the guide rope mechanically or electromechanically. For this purpose the suspension points may be equipped with coupling devices to which the suspension devices may be coupled. However, the suspension devices are preferably clamped or firmly anchored to the guide ropes. The suspension devices are preferably fixed to each guide rope at regular intervals. The distances are chosen so that the membrane piece arranged between two suspension devices is tensioned as soon as the two suspension devices are fixed to the guide rope. Since the peripheral structure generally has a different shape (e.g. polygonal) from that of the edge rope spanned above the opening (arc-shaped), the membrane is preferably suspended on the suspension devices cardanically to prevent the membrane from twisting during spanning. The suspension points of neighboring guide ropes are preferably offset so that the membrane can be folded when the roof element is moved to the parking position in a space saving manner.

In a special embodiment of the roof element according to the invention the membrane is permanently fixed to the edge rope. The membrane is then moved out at the same time as the edge rope. No further devices are then required to enable the membrane to follow the guide rope. Alternatively, however, it is also possible to provide detachable fixing of the membrane to the edge rope. The membrane can be subsequently spanned when the edge rope is already in the shading position.

In order to position the roof element according to the invention as unobtrusively as possible it is advantageous for the edge rope and the membrane in the parking position to be recessed in the peripheral structure or in a housing surrounding the peripheral structure. In the first case the peripheral structure must be designed to receive the membrane, the guide rope and edge rope. The peripheral structure and the housing preferably have swivel flaps with which the peripheral structure or housing is lockable so that the individual elements of the roof element according to the invention are not visible in the parking position.

To enable the membrane to be mounted over a large area the guide ropes are arranged separately from each other, preferably essentially in parallel. A parallel arrangement of the guide ropes allows, in particular, simple collapse of the membrane when the roof element is transferred to the parking position.

A special embodiment of the roof element according to the invention provides that the edge rope is fixed at least with one of its ends to a fixed point of the peripheral structure, and that the first tensioning device comprises a rope hoist with a loose roll and a pulling device which moves the loose roll along the peripheral structure, the edge rope serving as a tension rope for the rope hoist. Preferably the first tensioning device comprises a rope hoist and a pulling device for each edge rope end.

In an alternative variant the further tensioning device comprises a pulling device that is movable along the peripheral structure and on which the edge rope is fixed with one of its ends. The pulling device must be movable so far along the peripheral structure that the section of the peripheral structure over which the edge rope extends in the parking position is equal to at least the length of the arc of the edge rope spanned above the opening in the shading position. The first tensioning device for each edge rope end comprises a movable pulling device.

Both ends of the edge rope are therefore preferably fixed in the same manner to the peripheral structure. However, it is also possible to fix only one end of the edge rope via a pulling device or to secure both ends to the peripheral structure by means of differently designed pulling devices.

In a particularly preferred embodiment a slide movable on a rail, which is driven by a gear drive, is provided as a pulling device.

In another preferred embodiment a hydraulic cylinder is provided as a pulling device.

To provide ventilation of the space underneath the roof element and a reduction in the wind forces acting on the roof element, the membrane may have vent openings, preferably in the form of slots running parallel with the guide ropes. In particular, the membrane may comprise a multiplicity of membrane segments (particularly membrane strips), wherein adjacent membrane strips are connected to each other by the suspension devices and are secured to common suspension points on the guide rope when the roof element is transferred from the parking position to the shading position. The vent openings which may designed as almond-shaped slots, for example, are formed between the membrane strips. As an alternative to this, however, a one-piece membrane with slots may also be provided.

In a preferred further development of this embodiment the vent openings run in an arc shape between the suspension points and are preferably provided with flexible edge reinforcements for the extensive pretensioning of the membrane. The membrane therefore runs between the edge reinforcements in a concave manner. Because of the edge reinforcement, sections of the membrane (e.g. membrane segments designed as membrane strips) are pretensioned by the edge reinforcement and fluttering of individual membrane regions in wind can therefore be avoided.

The peripheral structure may be part of one or more building walls. The building walls must then be correspondingly strengthened in order to absorb the forces generated. As an alternative to this a steel supporting structure, on which building to be shaded is positioned, may serve as a peripheral structure, for example.

The edge rope of the roof element according to the invention is preferably moveable into a plurality of shading positions which are differentiated by the course of the edge rope above the opening of the peripheral structure, wherein the membrane is not fully folded up in at least one of the shading positions. According to the position of the sun or the area to be shaded, different coverings of the opening may be selected, the edge rope and the membrane being extended a greater or shorter distance.

The invention also relates to a roof structure comprising a plurality of the roof elements described above. The roof elements are preferably arranged distributed over the circumference of the peripheral structure so that the largest possible shading area can be achieved. Because of the arrangement of a plurality of roof elements different regions of the inner courtyard can be shaded according to the position of the sun, whereas a maximum size of area not covered by a roof can be achieved (and hence optimum air circulation). In this case it may be sufficient for different roof elements of a roof structure only to be provided with a common peripheral structure.

In a particularly preferred embodiment of the roof structure according to the invention the roof elements partially overlap in their shading position, thus guaranteeing comprehensive shading.

The invention also relates to a method for operating a convertible roof element described above. According to the invention the edge rope is transferred from the parking position to the shading position by increasing the ratio: tensile force of the first tensioning device/tensile force of the further tensioning device, the transfer of the edge rope from the shading position to the parking position being achieved by reducing the ratio "tensile force of the first tensioning device/tensile force of the further tensioning device".

The shading position is preferably selected as a function of the position of the sun and/or the area to be shaded.

In a particularly preferred variant the membrane is extended simultaneously with the edge rope.

The guide ropes are preferably rolled onto rope winches when the edge rope is transferred from the shading position to the parking position.

A special variant of the method according to the invention provides that the membrane and the edge rope are transferred simultaneously from the shading position to the parking position, wherein the membrane in the shading position is fixed by means of suspension devices to the edge rope and wherein the suspension devices are released by the edge rope and stacked one behind the other when the parking position is reached.

The roof element according to the invention allows flexible use due to the moveable edge rope and can be integrated unobtrusively into an existing building structure in its parking position. In addition to its function as a shading device, the roof element according to the invention may also be moved into the shading position at night in order, for example, to avoid cooling of the inner courtyard. The membrane and/or the suspension devices may additionally be equipped with light means, e.g. in the form of LEDs, in order to illuminate the inner courtyard for night use.

Further advantages of the invention may be deduced from the description and the drawings. Moreover, the features mentioned above and those listed below may be utilized individually or for a plurality in any combinations. The embodiments shown and described must not be understood as a final list but are given more in the nature of example for describing the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1A:
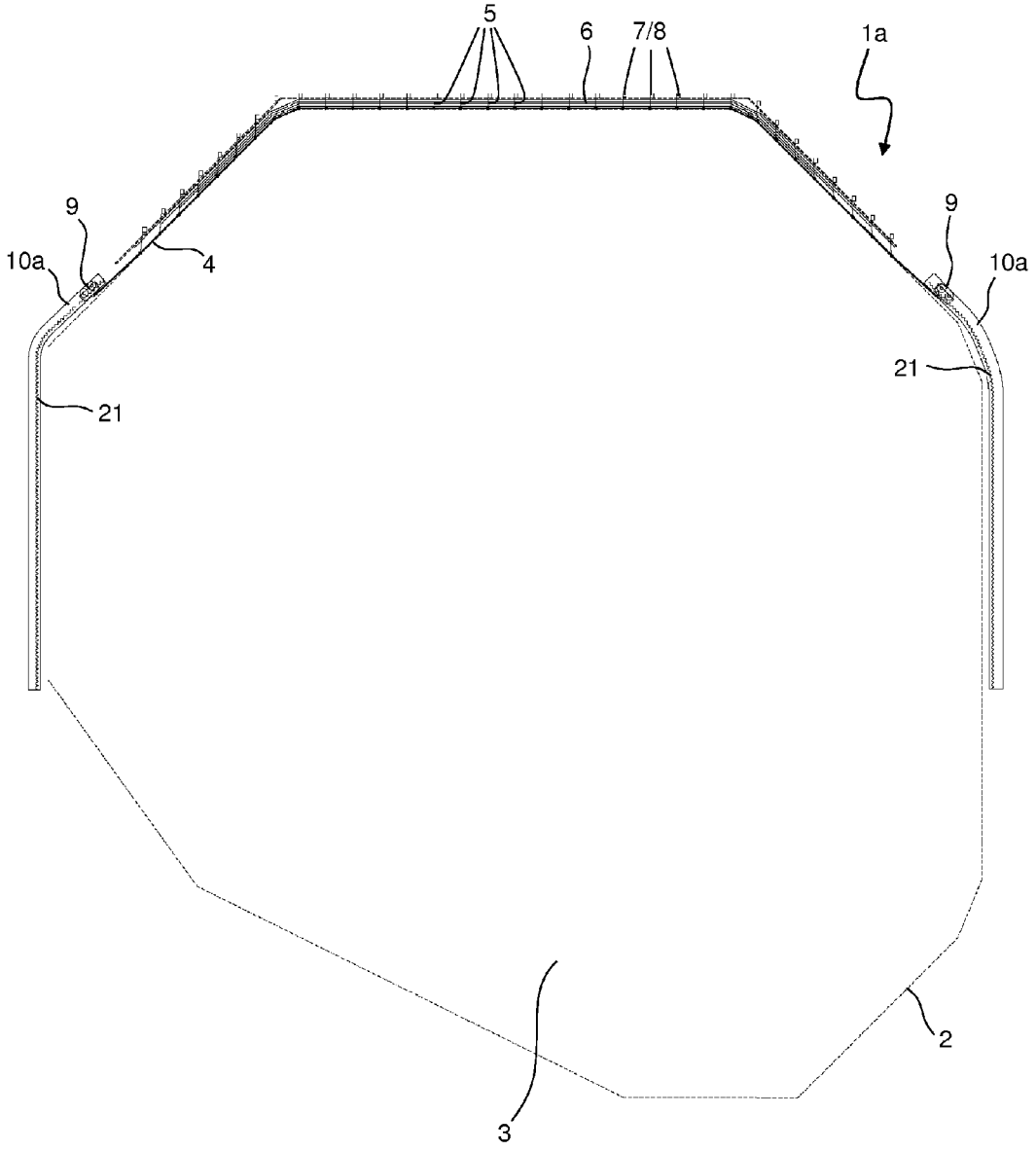
FIG. 1*a* shows an elevation of a first embodiment of the roof element according to the invention in park position with pulling carriages movable along the peripheral structure.

The convertible roof element 1*a*, 1*b* according to the invention comprises a peripheral structure 2 with an opening 3. Such structures may, for example, be walls of a building or external walls. The space inside the peripheral structure 2 (inner courtyard) will be shaded by means of roof element 1*a*, 1*b*, for which purpose an edge rope 4 is pretensioned across opening 3 in peripheral structure 2 (shading position). Moreover, a rope band consisting of a plurality of guide ropes 5 is tensioned between edge rope 4 and peripheral structure 2, which guide ropes retain on the one hand edge rope 4 in the desired position and shape, and on the other hand serve as a guide device for folding up and extending a membrane 6, which is guided along guide ropes 5. Guide ropes 5 are secured to peripheral structure 2 at separate peripheral points 7 via rope winches 8 onto which guide ropes 5 can be rolled and tensioned. By actuating a first tensioning device which acts on edge rope 4 and rolling on guide ropes 5, edge rope 4 is pulled in the direction of peripheral points 7 until edge rope 4 finally extends along peripheral structure 2 and therefore disappears out of the field of vision of the people who are in the inner courtyard of peripheral structure 2 (parking position).

Both in the parking position and in the shading position, and during the transfer to the different positions, guide ropes 5 and edge rope 4 are tensioned against one another, wherein either the tensile force of rope winches 8 and/or of the first tensioning device are varied in order to change the edge rope position so that edge rope 4 is pulled into the desired position. In the examples shown guide ropes 5 are tensioned by means of rope winches 8. Two preferred variants are described as the first tensioning device for pretensioning edge rope 4.

Figure 1B:
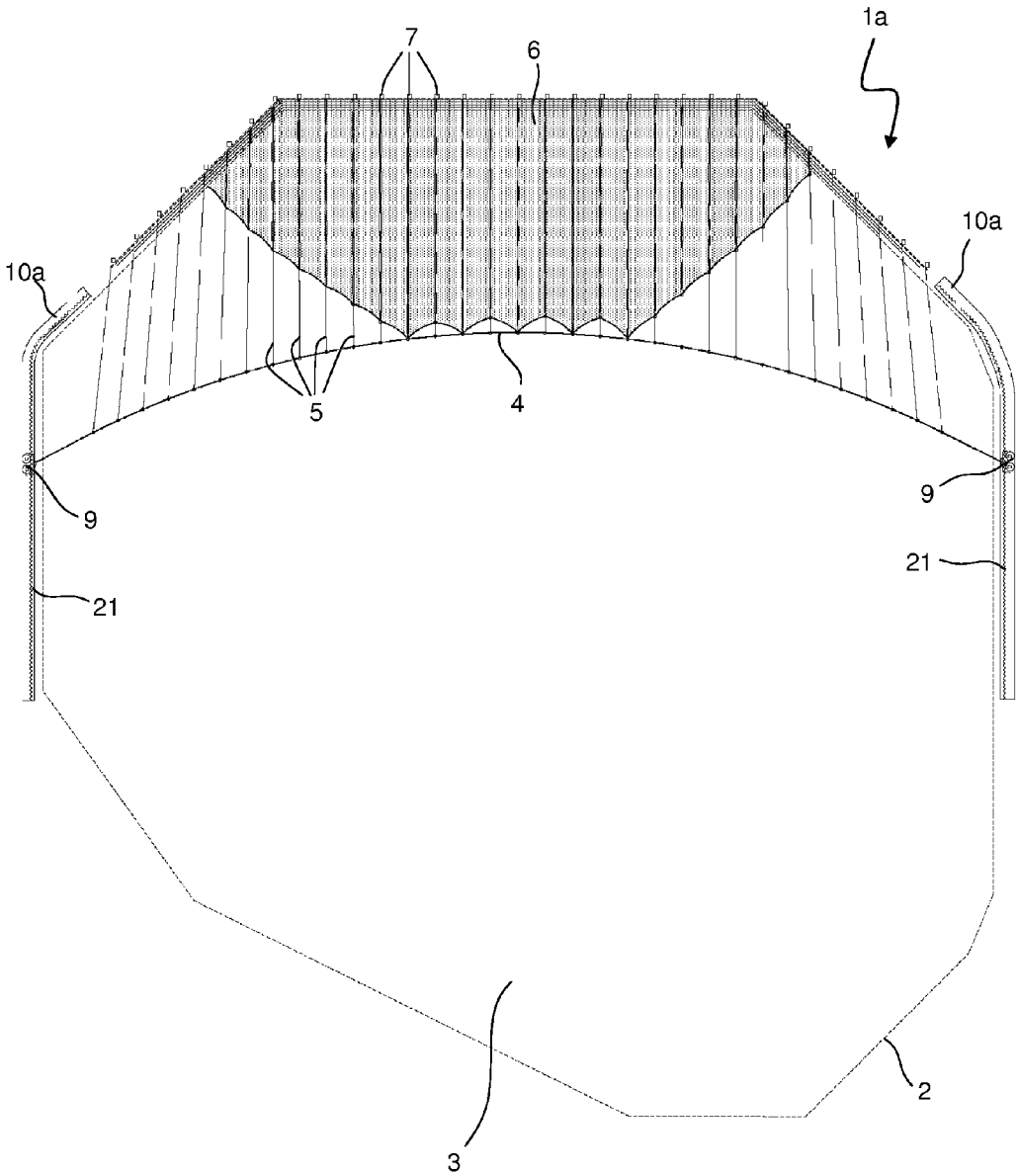
FIG. 1*b* shows an elevation of the roof element from FIG. 1*a* in a first shading position.
Figure 1C:
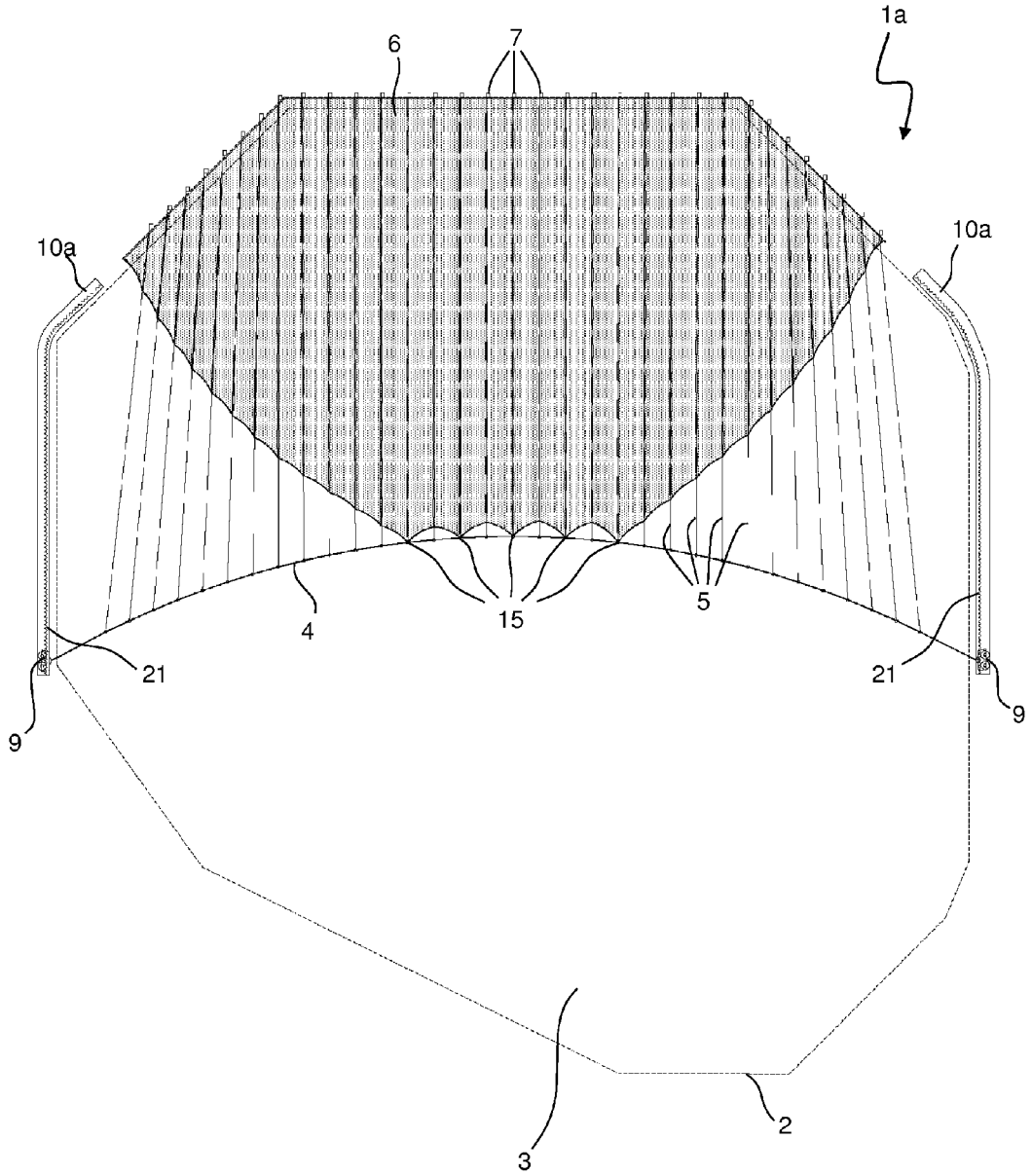
FIG. 1*c* shows an elevation of the roof element from FIG. 1*a* in a second shading position.

FIGS. 1*a-c* show a first embodiment of roof element 1*a* according to the invention. The ends of edge rope 4 are each secured to a slide 9 which can be moved on rails 10*a* rigidly connected to peripheral structure 2 (first tensioning device). Slides 9 are preferably driven by means of a gear drive 21 (illustrated diagrammatically). By moving slides 9 away from the peripheral points 7 at which guide ropes 5 are connected to peripheral structure 2, edge rope 4 is pulled from the circumference of peripheral structure 2 (parking position—FIG. 1*a*) into opening 3 of peripheral structure 2 (shading position—FIGS. 1*b*, 1*c*) and guide ropes 5 are rolled of their rope winches 8. Depending on the intended size of the shaded area edge rope 4 is pulled more or less into opening 3 of peripheral structure 2. FIG. 1*b* shows, for example, a shading position in which guide ropes 5 are rolled only partially from rope winches 8. In the shading position edge rope 4 runs in an arc above opening 3 of peripheral structure 2 and forms the boundary of the shading area. In the embodiment shown in FIGS. 1*a-c* rails 10*a* run along peripheral structure 2 so that when slides 9 are moved the length of the arc of edge rope 4 spanned across opening 3 of peripheral structure 2 remains the same. Only the curvature of the arc and the position of the rope ends change.

Figure 1D:
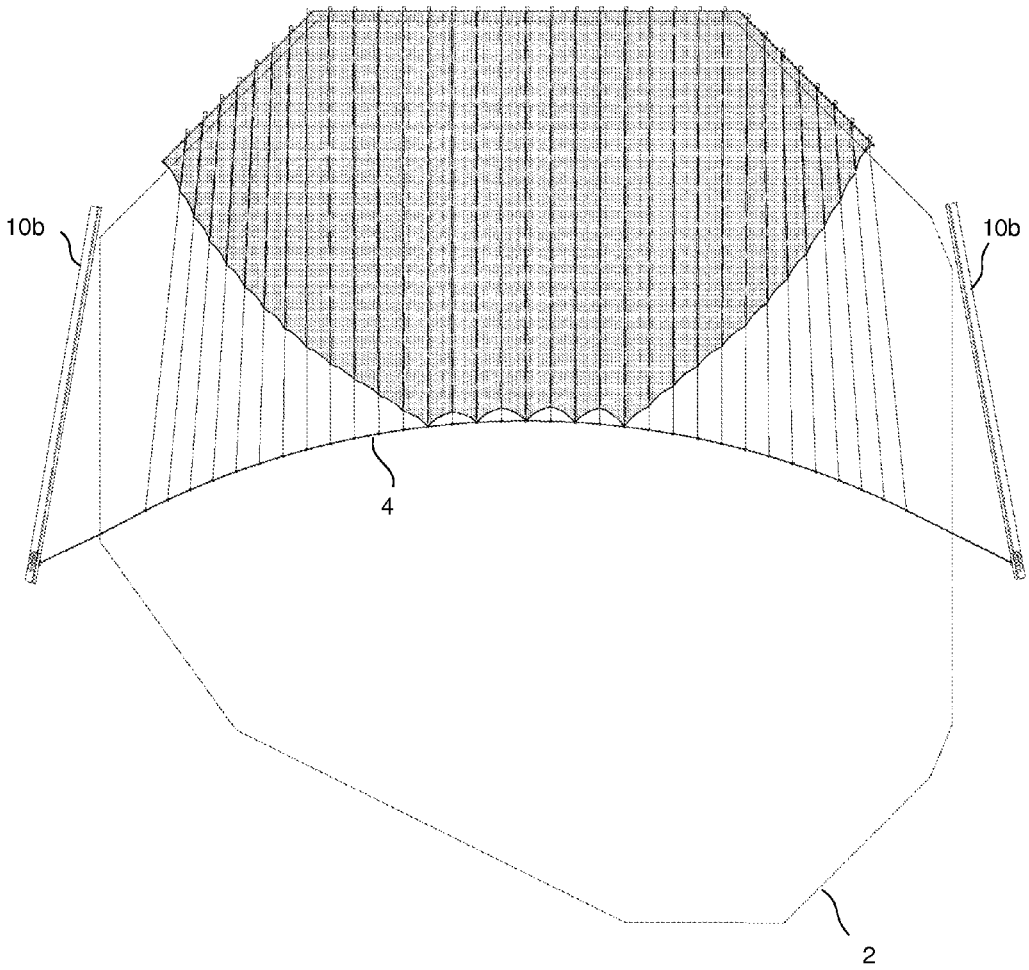
FIG. 1*d* shows an elevation of a second embodiment of the roof element according to the invention in shading position with pulling carriages moveable obliquely to the peripheral structure.
Figure 5:
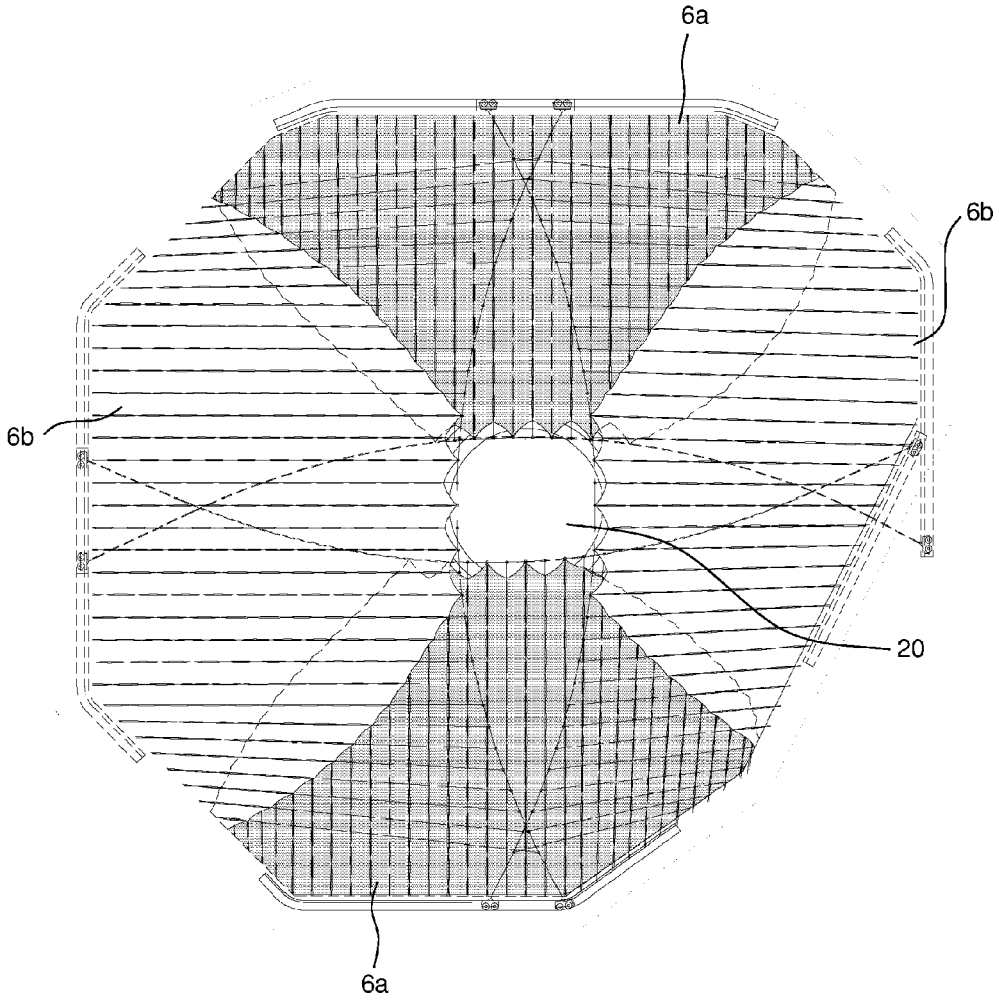
FIG. 5 shows an elevation of a roof structure according to the invention consisting of four convertible roof elements.

FIG. 1*d* shows an embodiment of roof element 1*a* according to the invention in which the first tensioning device is also realized by slides 9 moveable on rails 10*b*. In contrast to the example shown in FIGS. 1*a-c*, however, rails 10*b* do not run along peripheral structure 2 here but are arranged at an angle to peripheral structure 2. Rails 10*b*, arranged in such an oblique position, support the pretensioning of edge rope 4 when edge rope 4 moves into the shading position. It is also possible to provide rails which run partially along the peripheral structure and partially at an inclined angle to the peripheral structure (s. FIG. 5).

Figure 2:
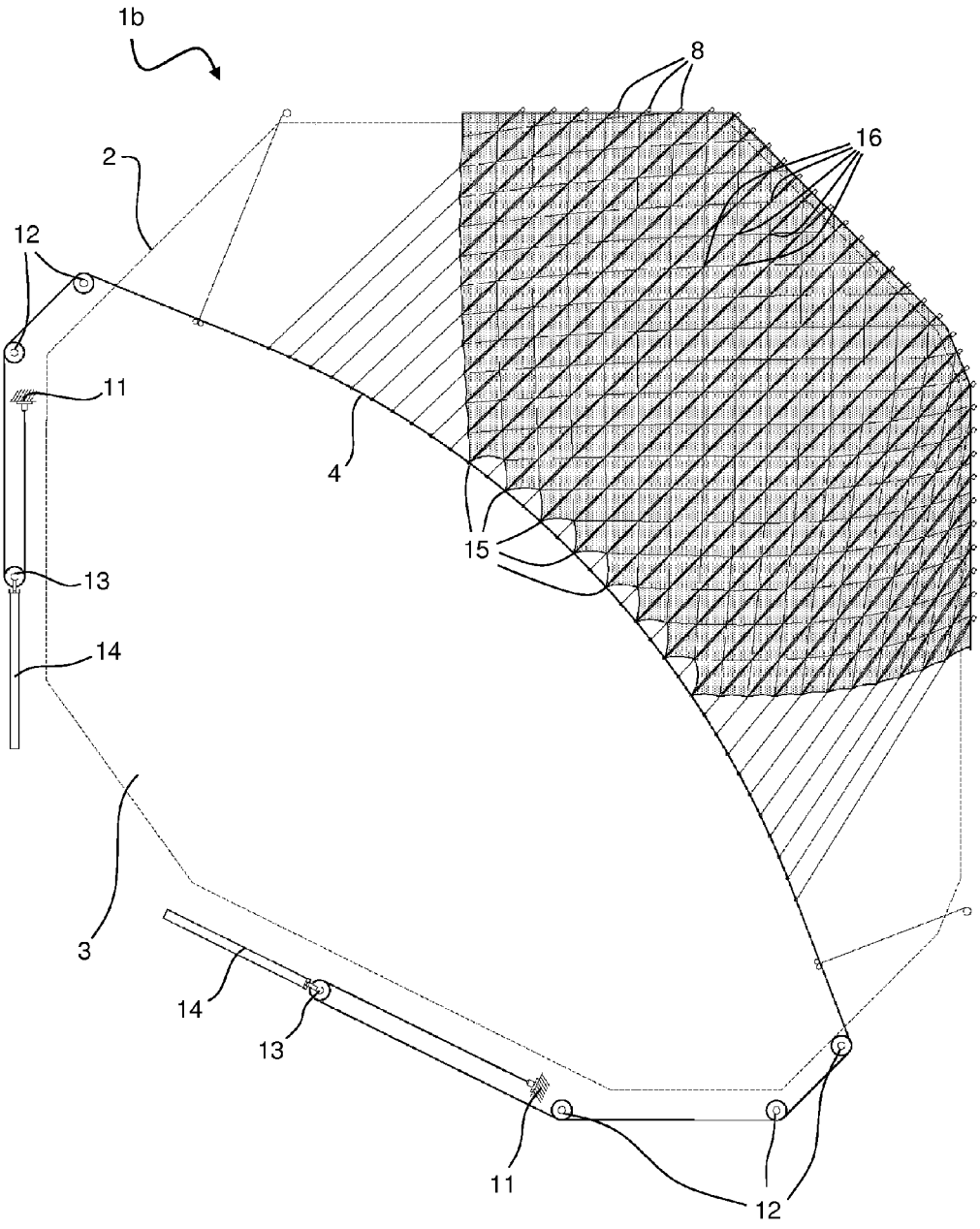
FIG. 2 shows an elevation of a further embodiment of the roof element according to the invention in shading position with hydraulic cylinders.

FIG. 2 shows a further embodiment of roof element 1*b* according to the invention, where the ends of edge rope 4 are fixed at a fixing point 11 to peripheral structure 2. The position of the rope ends is not therefore changed in this embodiment. Edge rope 4 runs at both ends via a plurality of fixed deflector rolls 12 and via a loose roll 13 which is secured to a hydraulic cylinder 14. Hydraulic cylinder 14 exerts a tensile force onto edge rope 4 running via the loose roll 13, as a result of which edge rope 4 is pulled from the circumference of peripheral structure 2 (parking position) into opening 3 of peripheral structure 2 (shading position—FIG. 2), and guide ropes 5 are rolled off their rope winches 8. The further edge rope 4 is pulled into opening 3 of peripheral structure 2, the more the length of the arc of edge rope 4 spanned across opening 3 of peripheral structure 2 is shortened, wherein the curvature of the arc is reduced. Alternatively or additionally the tensile force acting from rope winches 8 onto edge rope 4 can be reduced.

In the examples shown, membrane 6 providing the shade is secured to edge rope 4 at selected connection points 15 and is pulled and spanned together with edge rope 4 across opening 3 of peripheral structure 2. For this purpose membrane 6 is connected at suspension points 16 to suspension devices 17 (FIG. 3), which are secured, in particular clamped, to guide ropes 5 when guide ropes 5 are extended. This prevents excessive sagging of membrane 6. The number of suspension devices 17 provided depends on the size of membrane 6. In the shading position opening 3 of peripheral structure 2 is partially covered by membrane 6, which shades the inner courtyard underneath it.

In the examples shown peripheral structure 2 is polygonal in shape. During the transfer of edge rope 4 from the shading position to the parking position the shape that edge rope 4 forms changes, i.e. from the arc of a circle to a polygon. To avoid twisting of membrane 6 here, suspension devices 17 are equipped with a cardan suspension. As soon as suspension devices 17 have reached peripheral structure 2, they release guide ropes 5 and are stacked behind one another, which results in the collapse of membrane 6.

In the examples shown membrane 6 consists of a multiplicity of membrane segments in the form of strips, which are adapted to the shape of the intervals between guide ropes 5, so that the edges of the membrane segments all run essentially along a guide rope 5. In the examples shown guide ropes 5 run essentially parallel. Accordingly the membrane segments assume the form of strips. However, it is also conceivable for guide strips 5 to be arranged at an angle to each other and for correspondingly triangular or trapezoid membrane segments to be provided. The edges of the membrane segments are preferably secured to suspension devices 17 at regular intervals, adjacent membrane segments being connected to each other by these suspension devices 17. Between the individual suspension devices 17 the edges of the membrane segments may be provided with a concave design so that the membrane strips can be pretensioned extensively by flexible reinforcements of these arc-shaped edges, and so that fluttering of individual membrane regions is avoided in wind. Because of the spaced suspension and the concave design of the membrane edges slots are formed between suspension points 16 through which the inner courtyard is naturally ventilated.

Figure 3:
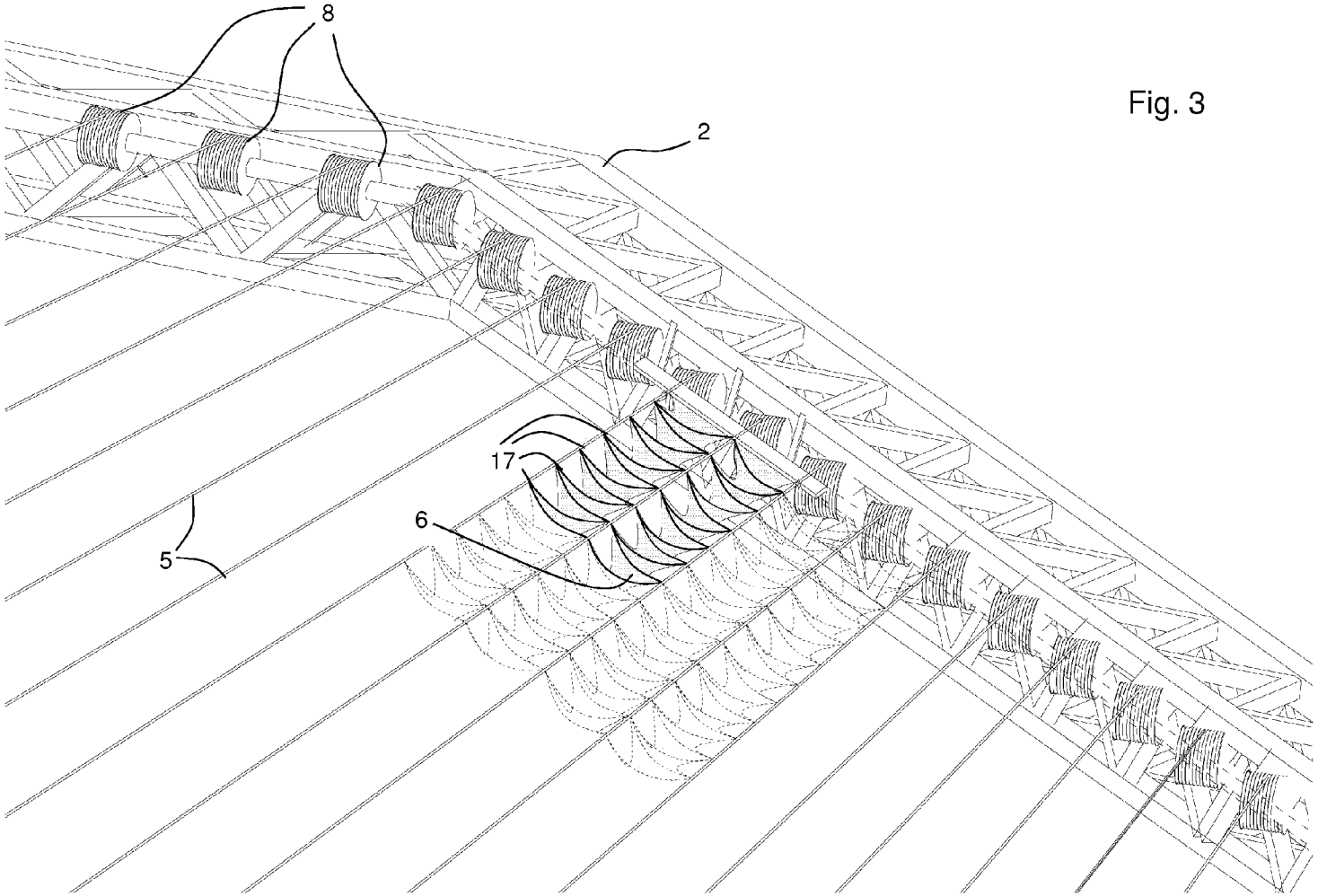
FIG. 3 shows a detailed view of a roof element according to the invention with a folded membrane.

FIG. 3 shows a detailed representation of peripheral structure 2 and collapsed membrane 6, where only part of membrane 6 is shown. Peripheral structure 2 is designed as a truss to which rope winches 8 are rigidly connected. The part of membrane 6 shown is in the collapsed condition. Guide ropes 5 have already been partially rolled onto rope winches 8 and suspension devices 17 are disconnected and pushed together by guide ropes 5 so that membrane 6 is pleated.

If edge rope 4 is moved back into a shading position guide ropes 5 are rolled off rope winches 8 and suspension devices 17 are—as soon as the membrane fold preceding the corresponding suspension devices 17 is folded up—clamped onto edge rope 4, whilst the remaining membrane folds and associated suspension devices 17 are initially still retained. In this manner membrane 6 can be spanned fold by fold, which enables the shaded area to vary, e.g. shading positions may be selected in which not all the membrane folds are folded up but part of membrane 6 remains folded in peripheral structure 2 (FIG. 1*b*). The synchronization of the first tensioning device (hydraulic cylinder 14, slides 9) and the further tensioning device (rope winches 8) with the fixing mechanism of suspension devices 17 is achieved by means of a central control system.

Figure 4A:
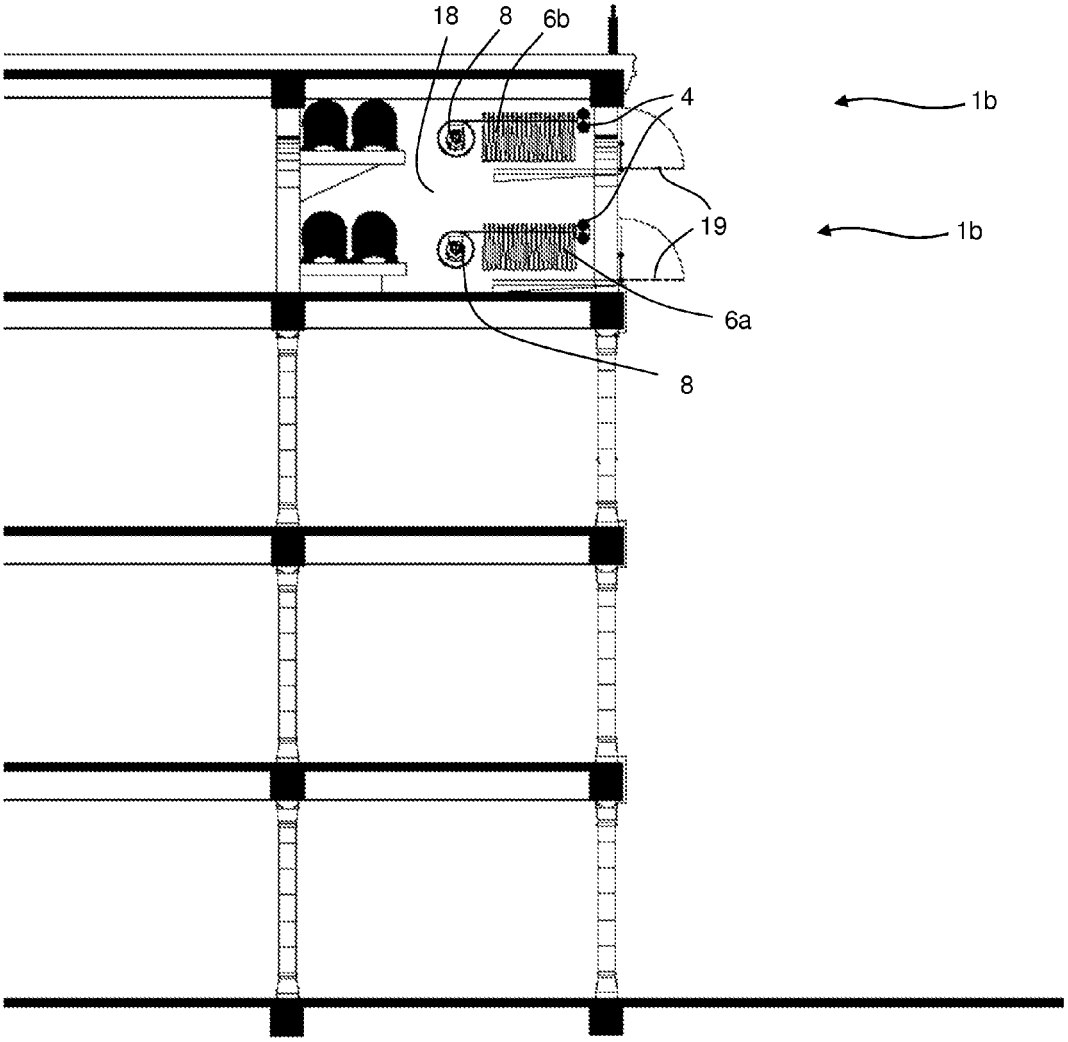
FIG. 4*a* shows a side view of a roof structure according to the invention in shading position with a plurality of convertible roof elements.
Figure 4B:
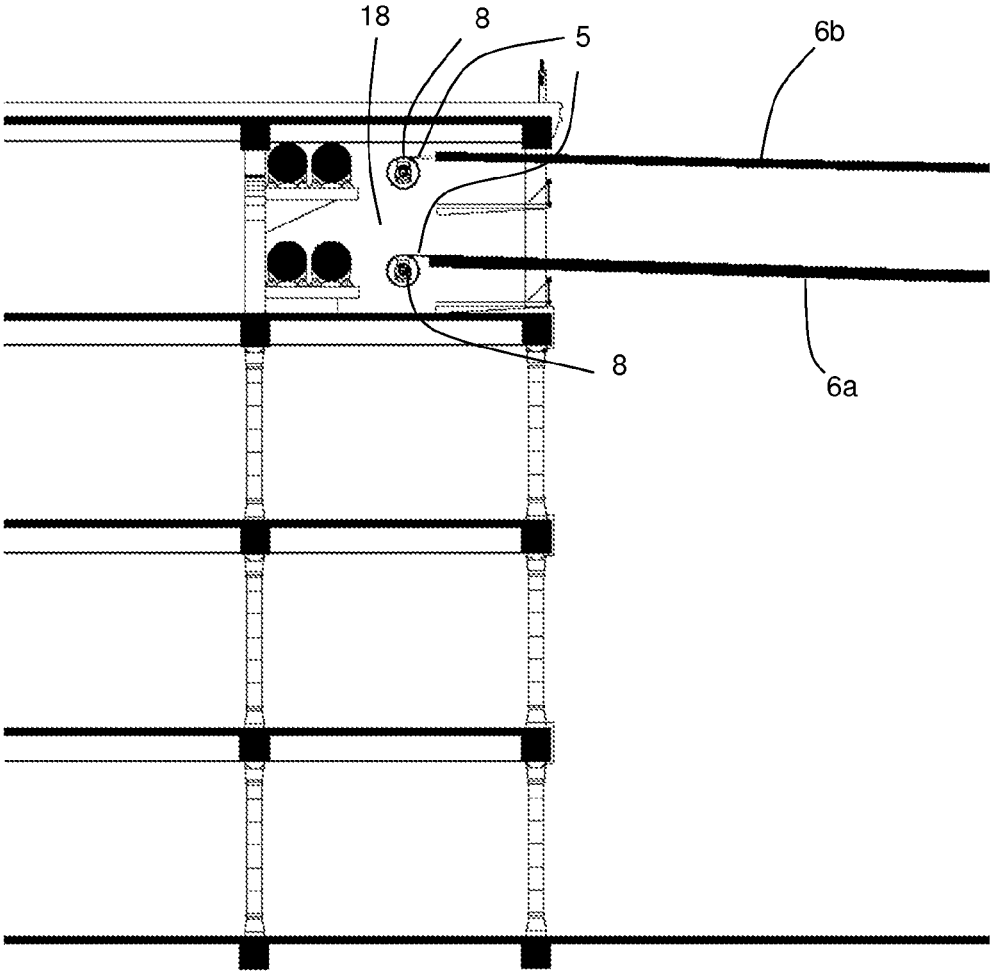
FIG. 4*b* shows a side view of a roof structure according to the invention in parking position with a plurality of convertible roof elements.

FIGS. 4*a*, 4*b* show side views of a roof structure according to the invention with two roof elements. Membranes 6*a*, 6*b* of the roof elements are arranged in two planes, guide ropes 5 of the different roof elements being spanned in different directions so that membrane 6*a*, 6*b* of the different roof elements partially overlap (see FIG. 5). The individual roof elements may be operated independently of each other so that optimum shading and ventilation can always be guaranteed independently of the position of the sun and the climatic situation. However, a synchronized operation is also possible.

FIG. 4*a* shows edge rope 4 in its parking position. Membrane 6 is fully collapsed and guide ropes 5 are rolled onto rope winches 8. The fixings of suspension devices 17 on guide ropes 5 are loosened so that suspension devices 17 can be installed so that they can be aligned one behind the other to save space. Edge rope 4, guide roles 5 and membrane 6 are recessed in a cavity 18 which can be sealed by swivel flaps 19, so that the entire structure is no longer visible. Here peripheral structure 2 integrated in the top story of a multi-story, ring-shaped building and set back from the lower floors so that the optics of the building are influenced as little as possible. Peripheral structure 2 may be part of the walls of the building or may even be installed separately (subsequently) in the building.

The forces acting because of the dead weight of the required components (edge rope 4, membrane 6, guide ropes 5) and the tensile forces caused by the pretension of edge rope 4 and the tensile forces caused by the rope winches act on peripheral structure 2, the tensile forces caused by rope winches 8 and guide ropes 5 being distributed over a large area of the circumference of peripheral structure 2. However, the forces generated by edge rope 4 act locally in the fixing regions, which must be taken into consideration in the construction of peripheral structure 2. Peripheral structure 2 must therefore be suitably reinforced at these points. The complete roof structure is especially suitable for large peripheral structures (a circumference of several hundred meters) and can be produced with prefabricated structural elements. To provide shade for an inner courtyard with a circumference of approx. 600 m, for example, steel guide ropes with a diameter of approximately 40 mm are sufficient. A double steel rope with a diameter of approximately 180 mm, for example, may be used as the edge rope. In areas of such size to be shaded it is advisable to provide a wind monitoring device which, from a certain wind strength, causes automatic transfer of the roof elements to the parking position.

FIG. 5 shows an elevation of a roof structure according to the invention with four roof elements 1*b*. Membranes 6*a*, 6*b* partially overlap and form a roofing with a central opening 20, the two membranes 6*a*, represented by a dotted line, being located in the lower lane and are partially covered by the two membranes 6*b* not represented by dotted lines. The individual roof elements 1*b* may be operated independently of each other, so that optimum shading and ventilation can always be guaranteed independently of the position of the sun and the climatic situation. However, synchronized operation is also possible.

Roof structures with an extraordinary design can be realized with the roof elements according to the invention, which structures offer a large shading area and—if they are not required—can be integrated into the walls of the inner courtyard to be shaded almost invisibly, so that the architectural effect of the building is not impaired.

NUMERALS

1*a*, 1*b* Roof element
2 Peripheral structure
3 Opening of the peripheral structure
4 Edge rope
5 Guide rope
6 Membrane
7 Peripheral points (fixing points of the guide ropes on the peripheral structure)
8 Rope winches (further tensioning device)
9 Slide
10*a* Rails
11 Fixing points (securing points of the edge rope on the peripheral structure)
12 Deflector rolls
13 Loose roll
14 Hydraulic cylinder (first tensioning device)
15 Connection points (points on the edge rope to which the membrane is secured)
16 Suspension points (points on the membrane to which the membrane is secured to the guide ropes)
17 Suspension devices
18 Cavity of the peripheral structure
19 Flaps
20 Central opening
21 Gear drive

What is claimed is:

1. A convertible roof element, comprising:

a peripheral structure with an opening to be covered by a membrane, an edge rope and at least one guide rope, the at least one guide rope forming a rope band, wherein the edge rope and the rope band are tensioned against each other;

wherein the convertible roof element has a parking position and at least one shading position, wherein in the parking position the edge rope runs along the peripheral structure and in the at least one shading position at least a portion of the edge rope runs across the opening of the peripheral structure;

wherein the edge rope is fixed at its ends via a first tensioning device to two fixing regions of the peripheral structure, the fixing regions being arranged at a certain distance from each other;

wherein the at least one guide rope is secured to the edge rope at one end and at the other end to the peripheral structure by means of a further tensioning device;

wherein the tensile force of the first tensioning device and/or of the further tensioning device is variable so that the edge rope is moveable from the parking position into the at least one shading position; and wherein in the at least one shading position, the membrane is at least partially folded up, fixed at at least one connection point to the edge rope, and covers part of the opening of the peripheral structure.

2. The convertible roof element according to claim 1, wherein the further tensioning device comprises at least one rope winch on which the at least one guide rope is rolled in the parking position.

3. The convertible roof element according to claim 2, wherein a plurality of guides ropes is provided, and the further tensioning device comprises a plurality of rope winches.

4. The convertible roof element according to claim 3, wherein the plurality of rope winches are synchronized when going between the parking position and the at least one shading position.

5. The convertible roof element according to claim 1, wherein the membrane is permanently fixed at the at least one connection point to the edge rope.

6. The convertible roof element according to claim 1, wherein in the parking position the edge rope and the membrane are recessed in the peripheral structure or in a housing surrounding the peripheral structure.

7. The convertible roof element according to claim 3, wherein the plurality of guide ropes are arranged in parallel and spaced apart.

8. The convertible roof element according to claim 1, wherein at least one end of the edge rope is fixed to a fixing point of the peripheral structure, where the first tensioning device comprises a loose roll attached to a pulling device, the edge rope disposed through the loose roll where a movement of the pulling device moves the loose roll along the peripheral structure which creates a tension in the edge rope.

9. The convertible roof element according to claim 8, wherein the pulling device comprises a hydraulic cylinder.

10. The convertible roof element according to claim 1, wherein the further tensioning device comprises a pulling device moveable along the peripheral structure, where at least one end of the edge rope is attached to the pulling device.

11. The convertible roof element according to claim 10, wherein the pulling device comprises a slide movable along a rail, the rail configured to follow at least a portion of the peripheral structure.

12. The convertible roof element according to claim 11, wherein the slide is driven along the rail by a gear drive.

13. The convertible roof element according to claim 3, wherein the membrane is secured to the at least one guide rope by a plurality of suspension devices, wherein the plurality of suspension devices are moveable along the guide rope.

14. The convertible roof element according to claim 1, wherein the membrane has vent openings.

15. The convertible roof element according to claim 14, wherein the vent openings run in an arc shape between the plurality of suspension points and are provided for the extensive pretensioning of the membrane with flexible edge reinforcements.

16. The convertible roof element according to claim 1, wherein the peripheral structure is part of one or more building walls.

17. The convertible roof element according to claim 1, wherein the edge rope is moveable into a plurality of shading positions which differ in the course of the edge rope above the opening of the peripheral structure, wherein the membrane is not fully folded up in at least one of the plurality of shading positions.

18. A convertible roof structure comprising at least two convertible roof elements according to claim 1.

19. The convertible roof element according to claim 18, wherein the membrane of the first convertible roof element in its at least one shading position overlaps the membrane of the second convertible roof element in its at least one second shading position.

20. A method for operating the convertible roof element according to claim 1, wherein the edge rope is transferred from the parking position to the at least one shading position by increasing the ratio of the tensile force of the first tensioning device in relation to the tensile force of the further tensioning device, and wherein the edge rope is transferred from the shading position to the parking position by reducing the ratio of the tensile force of the first tensioning device in relation to the tensile force of the further tensioning device.

21. The method according to claim 20, wherein the at least one shading position is selected as a function of the position of the sun and/or the area to be shaded.

22. The method according to claim 20, wherein the membrane is extended simultaneously with the edge rope.

23. The method according to claim 20, wherein the at least one guide rope is rolled onto a rope winch during the transfer of the edge rope from the at least one shading position to the parking position.

24. The method according to claim 20, wherein the membrane and the edge rope are simultaneously transferred from the at least one shading position to the parking position, wherein the membrane is fixed in the at least one shading position by means of suspension devices on the edge rope, and wherein the suspension devices are movable along the edge rope and are stacked one behind the other when the parking position is reached.

25. The convertible roof element according to claim 1, wherein in the parking position no disturbing elements of the convertible roof element are visible.

26. The convertible roof element according to claim 1, wherein the membrane, the guide rope and the edge rope are recessed in the peripheral structure when in the parking position.

27. The convertible roof element according to claim 1, wherein the membrane, the guide rope and the edge rope are recessed in a housing surrounding the peripheral structure when in the parking position.

28. The convertible roof element according to claim 1, wherein the architectural effect of a building is not impaired in the parking position.

29. The convertible roof element according to claim 1, wherein the at least one guide rope does not impair the aesthetic impression of a building when the convertible roof element is in the parking position.

* * * * *